US005637066A

United States Patent [19]

Chang

[11] Patent Number: 5,637,066

[45] Date of Patent: Jun. 10, 1997

[54] EXERCISE DEVICE

[76] Inventor: Sreter Chang, No. 451, Ta Tien Road, Homei Chen, Chang Hua Hsien, Taiwan

[21] Appl. No.: 655,648

[22] Filed: May 30, 1996

[51] Int. Cl.[6] ..... A63B 21/02

[52] U.S. Cl. ..... 482/126; 482/140; 482/128; 482/121

[58] Field of Search ..... 482/121, 122, 482/126, 128, 140

[56] References Cited

U.S. PATENT DOCUMENTS

| | | | |
|---|---|---|---|
| 2,930,614 | 3/1960 | McIntosh | 482/126 |
| 3,759,514 | 9/1973 | Cox | 482/126 |
| 4,290,600 | 9/1981 | Kolbel | 482/126 |
| 5,031,906 | 7/1991 | Jang | 482/126 |
| 5,046,726 | 9/1991 | Van Straaten | 482/128 |
| 5,154,685 | 10/1992 | Chen | 482/126 |
| 5,232,425 | 8/1993 | Miller et al. | 482/126 |

*Primary Examiner*—Lynne A. Reichard
*Attorney, Agent, or Firm*—Beveridge, DeGrandi, Weilacher & Young LLP

[57] ABSTRACT

An exercise device comprises a first handle, a second handle, an outer pipe, an inner pipe, an elastic ring, and three elastic pipes. Three recesses are formed on an upper middle portion of the first handle. A stud is positioned on a center of the first handle. A box is disposed on a center of the second handle. Three grooves are formed on an upper portion of the hollow box. A circular through hole is formed on a rear end of the inner pipe. Three notches are formed on a front end of the inner pipe. Each elastic pipe has a first and second balls disposed at a front and rear ends of each elastic pipe. A rear end of the elastic ring is inserted in the stud. The stud is inserted in the rear end of the outer pipe. A first fastener positions the stud in the outer pipe and the elastic ring in the stud. A front end of the elastic ring is inserted in the inner pipe. The inner pipe is inserted in the front end of the outer pipe. A second fastener positions the inner pipe in the outer pipe and the elastic ring in the inner pipe.

1 Claim, 4 Drawing Sheets

EXERCISE DEVICE

BACKGROUND OF THE INVENTION

The invention relates to an exercise device. More particularly, the invention relates to an exercise device for various exercising purposes.

Most conventional exercise devices have simple training functions and purposes. One type of exercise device cannot be converted to the other type of exercise device. If an exercise device provides many different training functions, the exercise device should have complex structure. Thus the complex exercise device may be very expensive. It is very difficult to familiarize the operation of the complex exercise.

SUMMARY OF THE INVENTION

An object of the invention is to provide an exercise device for various exercising purposes.

Accordingly, an exercise device comprises a first handle, a second handle, a hollow outer pipe, a hollow inner pipe, an elastic ring, and a first, second and third hollow elastic pipes. A curved plate is positioned on a rear middle portion of the first handle. A first, second and third recesses are formed on an upper middle portion of the first handle. A hollow stud is positioned on a center of the first handle. A round through hole is formed on the hollow stud. A first and second foam casings enclose a right and left portions of the first handle, respectively. A hollow box is disposed on a center of the second handle. A first, second and third grooves are formed on an upper portion of the hollow box. A first and second foam housings enclose a right and left portions of the second handle, respectively. A circular through hole is formed on a rear end of the hollow inner pipe. A first, second and third notches are formed on a front end of the hollow inner pipe. Each of the first, second and third hollow elastic pipes has a first and second balls disposed at a front and rear ends of each of the first, second and third hollow elastic pipes, respectively. A rear end of the elastic ring is inserted in the hollow stud. The hollow stud is inserted in the rear end of the hollow outer pipe. A first fastener positions the hollow stud in the hollow outer pipe and the elastic ring in the hollow stud. A front end of the elastic ring is inserted in the hollow inner pipe. The hollow inner pipe is inserted in the front end of the hollow outer pipe. A second fastener positions the hollow inner pipe in the hollow outer pipe and the elastic ring in the hollow inner pipe. Each of the first, second and third hollow elastic pipes is inserted in the corresponding recess and the corresponding groove, respectively.

DETAILED DESCRIPTION OF THE INVENTION

Figure 1:
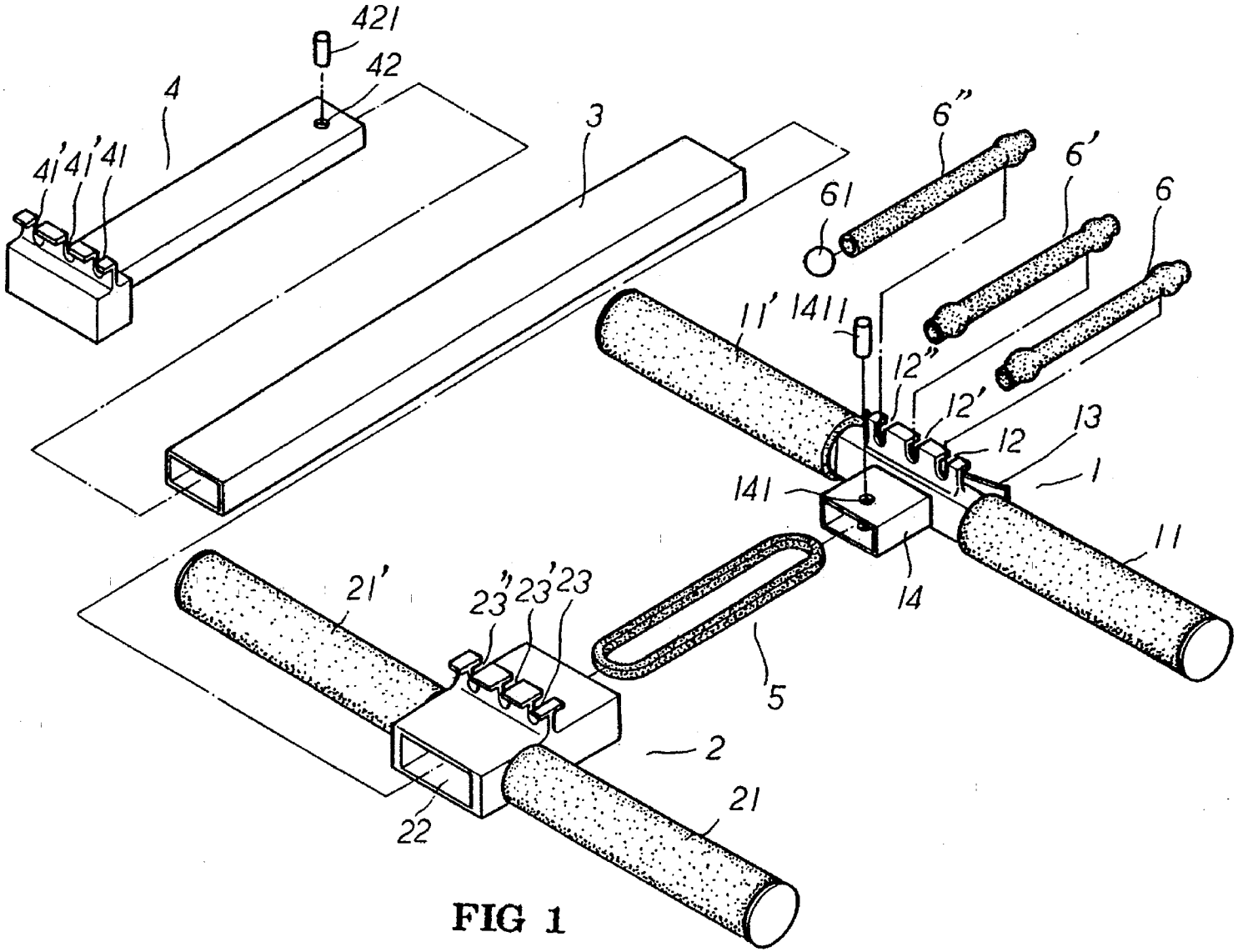
FIG. 1 is a perspective exploded view of an exercise device of a preferred embodiment in accordance with the invention.
Figure 2:
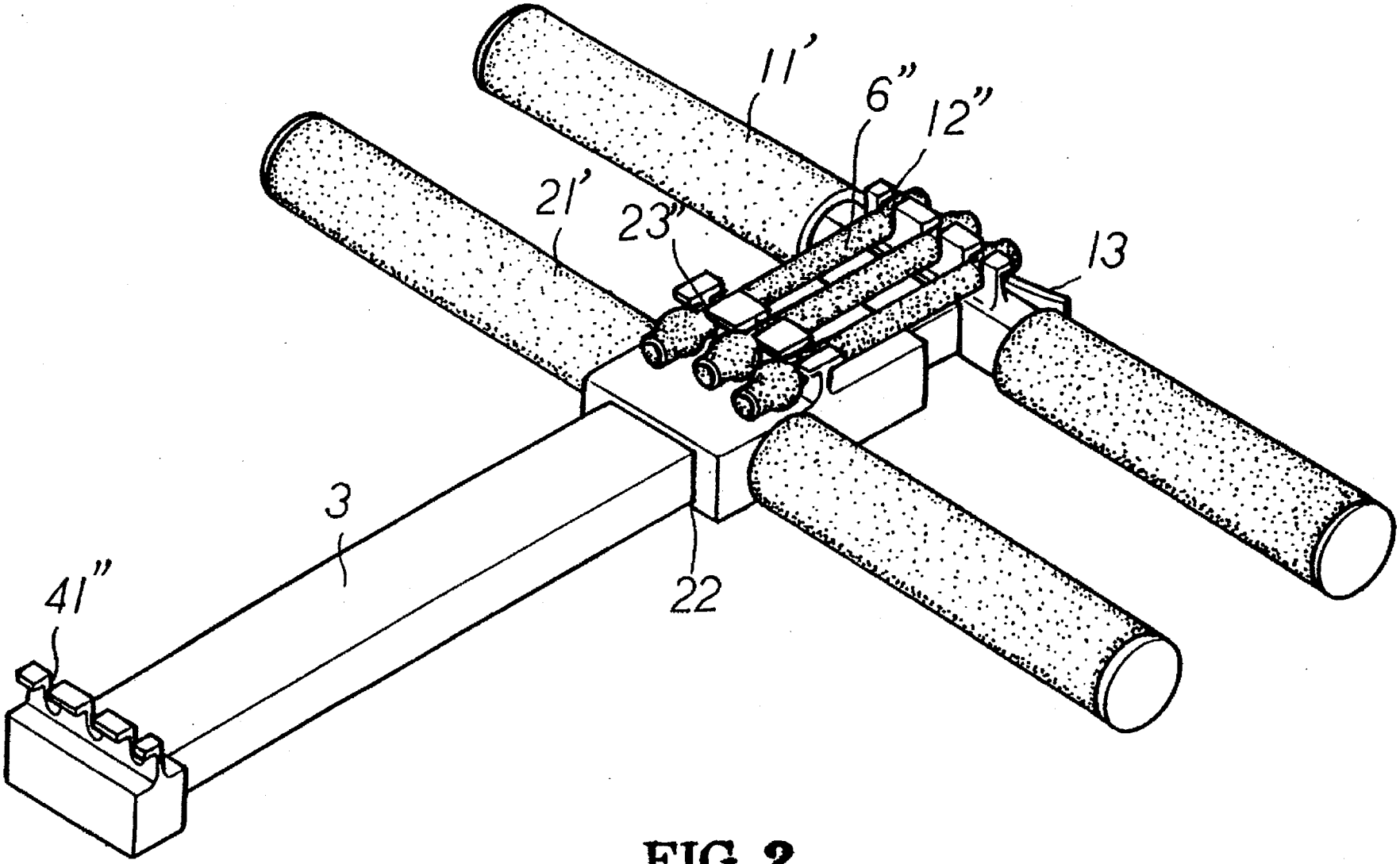
FIG. 2 is a perspective assembly view of an exercise device of a preferred embodiment in accordance with the invention.
Figure 3:
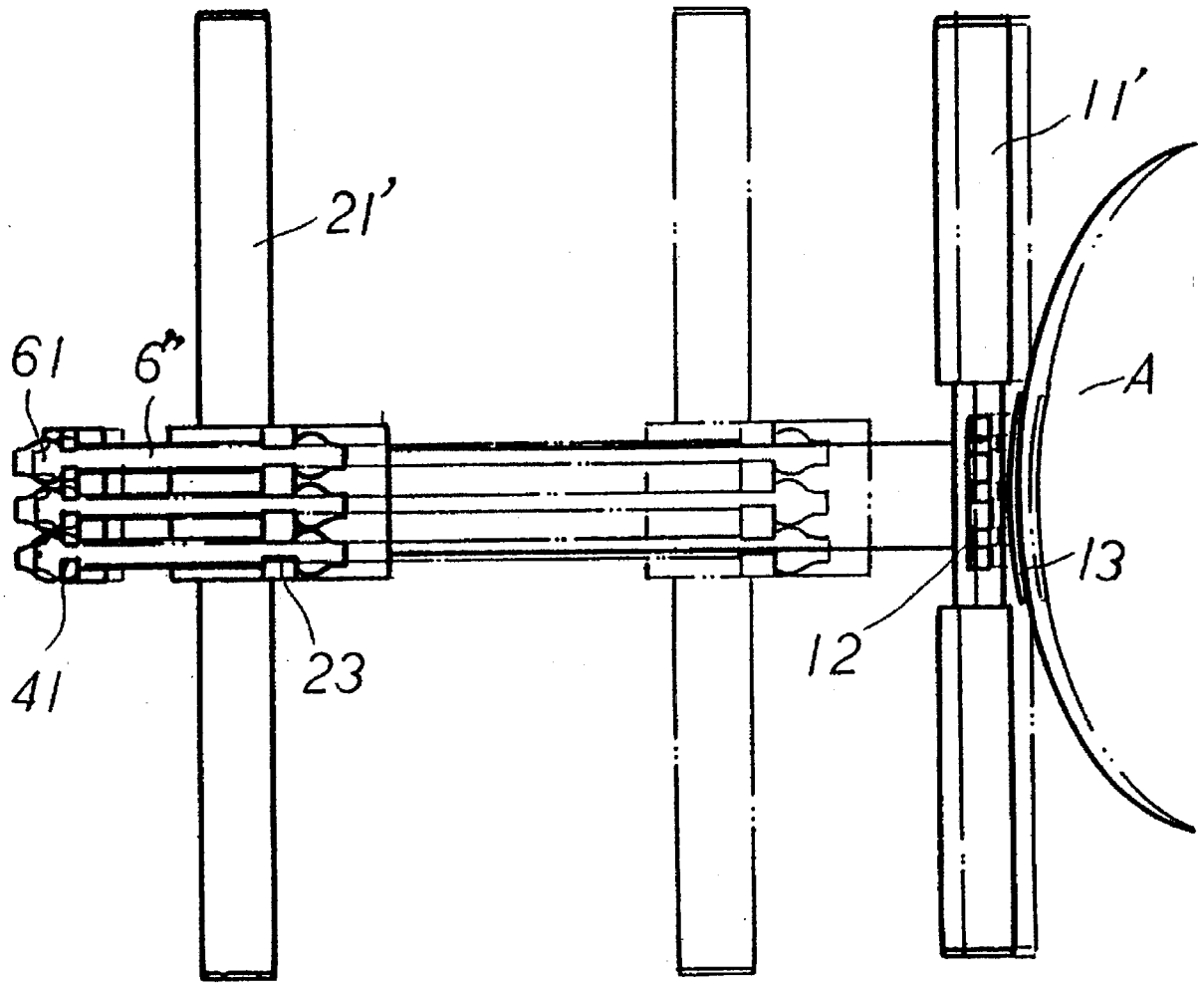
FIG. 3 is a schematic view illustrating an operation of an exercise device.
Figure 4:
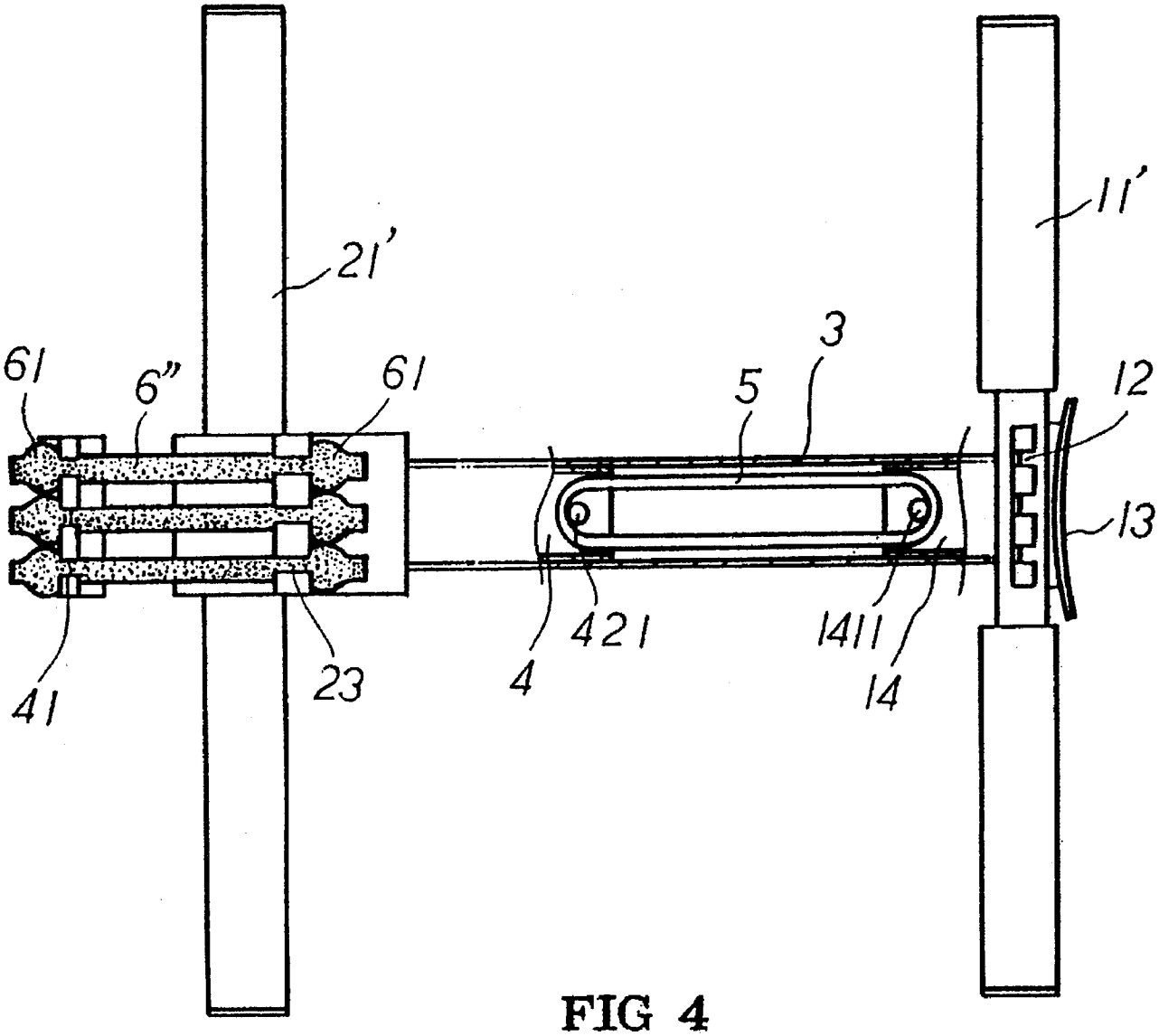
FIG. 4 is a partially sectional view illustrating an elastic ring in an exercise device.

Referring to FIGS. 1 and 2, an exercise device comprises a first handle 1, a second handle 2, a hollow outer pipe 3, a hollow inner pipe 4, an elastic ring 5, and a first, second and third hollow elastic pipes 6, 6' and 6". A curved plate 13 is positioned on a rear middle portion of the first handle 1 to abut the belly of the user. A first, second and third recesses 12, 12' and 12" are formed on an upper middle portion of the first handle 1. A hollow stud 14 is positioned on a center of the first handle 1. A round through hole 141 is formed on the hollow stud 14. A first and second foam casings 11 and 11' enclose a right and left portions of the first handle 1, respectively. A hollow box 22 is disposed on a center of the second handle 2. A first, second and third grooves 23, 23' and 23" are formed on an upper portion of the hollow box 22. A first and second foam housings 21 and 21' enclose a right and left portions of the second handle 2, respectively. A circular through hole 42 is formed on a rear end of the hollow inner pipe 4. A first, second and third notches 41, 41' and 41" are formed on a front end of the hollow inner pipe 4. Each of the first, second and third hollow elastic pipes 6, 6' and 6" has a first and second balls 61 disposed at a front and rear ends of each of the first, second and third hollow elastic pipes 6, 6' and 6", respectively. A rear end of the elastic ring 5 is inserted in the hollow stud 14. The hollow stud 14 is inserted in the rear end of the hollow outer pipe 3. A first pin 1411 positions the hollow stud 14 in the hollow outer pipe 3 and the elastic ring 5 in the hollow stud 14. A front end of the elastic ring 5 is inserted in the hollow inner pipe 4. The hollow inner pipe 4 is inserted in the front end of the hollow outer pipe 3. A second pin 421 positions the hollow inner pipe 4 in the hollow inner outer pipe 3 and the elastic ring 5 in the hollow inner pipe 4. Each of the first, second and third hollow elastic pipes 6, 6' and 6" can be inserted in the corresponding recess 12, 12' or 12" and the groove 23, 23' or 23", respectively. If the user has a strong force, each elastic pipe 6, 6' or 6" can be inserted in the corresponding groove 23, 23' or 23" and the notch 41, 41' or 41", respectively (as shown in FIGS. 3 and 4). The belly A of the user abuts the curved plate 13. Two hands of the user grip the first and second foam housings 21 and 21' and press the second handle 2 toward the belly A.

The feet of the user can touch the first and second foam casings 11 and 11', and the knees of the user can lift the second handle 2 upward.

The invention is not limited to the above embodiment but various modification thereof may be made. Further, various changes in form and detail may be made without departing from the scope of the invention.

I claim:

1. An exercise device comprising:

a first handle, a second handle parallel to said first handle, a hollow outer pipe, a hollow inner pipe, an elastic ring, at least a hollow elastic pipe, a curved plate positioned on a rear middle portion of said first handle, at least a recess formed on an upper middle portion of said first handle, a hollow stud positioned on a center of said first handle, a round through hole formed on said hollow stud, a first and second foam casings enclosing right and left portions of said first handle, respectively, a hollow box disposed on a center of said second handle, at least a groove formed on an upper portion of said hollow box, a first and second foam housings enclosing right and left portions of said second handle, respectively, a circular through hole formed on a rear end of said hollow inner pipe, at least a notch formed on a front end of said hollow inner pipe, said hollow elastic pipe having first and second balls disposed at front and rear ends of said hollow elastic pipe, a rear end of said elastic ring inserted in said hollow stud, said hollow stud inserted in said rear end of said hollow outer pipe, a first fastener positioning said hollow stud in said hollow outer pipe and said elastic ring in said hollow stud, a front end of said elastic ring inserted in said hollow inner pipe, said hollow inner pipe inserted in said front end of said hollow outer pipe, a second fastener positioning said hollow inner pipe in said hollow outer pipe and said elastic ring in said hollow inner pipe, said hollow elastic pipe inserted in said corresponding recess and said corresponding groove, respectively.

* * * * *